US008723904B2

(12) United States Patent
Marty et al.

(10) Patent No.: US 8,723,904 B2
(45) Date of Patent: May 13, 2014

(54) MOBILE PRINTER WITH OPTIONAL BATTERY ACCESSORY

(75) Inventors: William A. Marty, Seattle, WA (US); Dean Jeffrey Bidwell, Renton, WA (US); John S. Bandringa, Everett, WA (US); Bruce Morton, Lake Stevens, WA (US)

(73) Assignee: Intermec IP Corp., Fort Mill, S.C.

( * ) Notice: Subject to any disclaimer, the term of this patent is extended or adjusted under 35 U.S.C. 154(b) by 103 days.

(21) Appl. No.: 13/497,980

(22) PCT Filed: Sep. 24, 2010

(86) PCT No.: PCT/US2010/050213

§ 371 (c)(1), (2), (4) Date: Mar. 23, 2012

(87) PCT Pub. No.: WO2011/038239

PCT Pub. Date: Mar. 31, 2011

(65) Prior Publication Data

US 2012/0176461 A1 Jul. 12, 2012

Related U.S. Application Data

(60) Provisional application No. 61/246,090, filed on Sep. 25, 2009.

(51) Int. Cl.
*B41J 2/325* (2006.01)

(52) U.S. Cl.
USPC ..... 347/222

(58) Field of Classification Search
USPC ..... 347/108, 197, 222; 400/88, 613, 692, 400/693; 361/679.27
See application file for complete search history.

(56) References Cited

U.S. PATENT DOCUMENTS

| | | | |
|---|---|---|---|
| 4,759,646 | A | 7/1988 | Piatt |
| 6,092,945 | A | 7/2000 | Takami et al. |
| 6,219,227 | B1 | 4/2001 | Trane |
| 2007/0291055 | A1 | 12/2007 | Silverbrook |

FOREIGN PATENT DOCUMENTS

JP 2005169896 A 6/2005

OTHER PUBLICATIONS

HP Planet Partners Return and Recycling Program www.hp.com [online]. 2007 [retrieved Nov. 8, 2010]. Retrieved from the internet: http://www.hp.com/hpinfo/newsroom/press_kits/2008/macworld/ds_hpplanetpartners_recyclingprogram.pdf.

International Written Opinion and Search Report, PCT/US2010/050213, mailed Nov. 19, 2010.

*Primary Examiner* — Kristal Feggins
(74) *Attorney, Agent, or Firm* — Additon, Higgins, Pendleton & Ashe, P.A.

(57) ABSTRACT

A mobile printer comprising a printer body and a printer door is provided. The printer body has a recessed area that is sized to receive a media roll. The media roll has a void interior portion that is sized to receive one or more batteries that provide power to the mobile printer. Further, the printer door is operatively coupled to the printer body. When in an open position, the printer door allows for placement of a media roll from a side of the mobile printer into the recessed area. When closed, however, the media roll is retained in place relative to the printer body and the media from the media roll is captured for printing.

19 Claims, 6 Drawing Sheets

MOBILE PRINTER WITH OPTIONAL BATTERY ACCESSORY

RELATED APPLICATIONS

This application is a national phase U.S. application of PCT Application No. PCT/US2010/050213 filed on Sep. 24, 2010, which claims priority to U.S. Provisional Application Ser. No. 61/246,090, filed on Sep. 25, 2009, both applications hereby being incorporated by reference.

SUMMARY

Embodiments of the invention are defined by the claims below, not this summary. A high-level overview of various aspects of embodiments of the invention is provided here for that reason, to provide an overview of the disclosure and to introduce a selection of concepts that are further described below in the detailed-description section. This summary is not intended to identify key features or essential features of the claimed subject matter, nor is it intended to be used as an aid in isolation to determine the scope of the claimed subject matter.

Embodiments of the present invention relate generally to a mobile printer designed to use roll media. The mobile printer is uniquely small because of the arrangement of components within. For instance, batteries used to power the mobile printer may be housed inside of a media roll instead of taking up space in a different area of the mobile printer. The size of the mobile printer described herein has been optimized such that the printer and the media roll do not take up separate space in the mobile printer, but instead share the same space that the media roll would originally have taken. In one instance, the media roll is loaded into the mobile printer such that a battery spindle extends through the otherwise hollow core area of the media roll so that batteries can be placed inside of the battery spindle. The media roll may be loaded into the mobile printer from a side of the printer. When the printer door closes, several actions are accomplished. Initially, the media roll is held in place relative to the printer. Further, the media on the media roll is captured between a platen roller coupled to the printer door and a print head such that the media is firmly pressed against the print head for even printing. Because of the shape and size of both an inside portion of the media roll and the battery spindle, the media roll can only be loaded into the printer the correct way, which removes the usual ambiguity in media loading. This ambiguity typically arises as in the embodiments of thermal printers, the thermal coating is only applied to one side of the paper, and thus if the paper is loaded into the printer incorrectly, the paper will not be printed.

Even further, the mobile printer is designed to be powered by batteries in the core of the media roll thus achieving a certain print speed. Optionally, an external battery accessory may be removably attached to the mobile printer to provide for a higher print speed. Thus, user is given the option to optimize the mobile printer for size and weight, or for print speed. Yet another embodiment relates to packaging media and battery consumables together. Generally, users of mobile printers typically manage two flows of consumables. Users purchases rolls of media, and replace them in the printer as the media is consumed. Users also purchase and replace primary batteries in the mobile printer, or recharge secondary batteries in the mobile printer by connecting an external power source. This recharging operation may occur while batteries are in the mobile printer, or alternatively batteries may be removed from the mobile printer and placed in an external recharging device. According to embodiments of the present invention, users manage only a single flow of consumables such that a user purchases rolls of media which come loaded with charged batteries. When the media on a roll is consumed, and the batteries contained in the media roll are depleted, the media core tube containing depleted batteries is returned to the media vendor for battery recharging and media reloading.

BRIEF DESCRIPTION OF THE SEVERAL VIEWS OF THE DRAWINGS

Illustrative embodiments of the present invention are described in detail below with reference to the included drawing figures, wherein.

DETAILED DESCRIPTION

Figure 1:
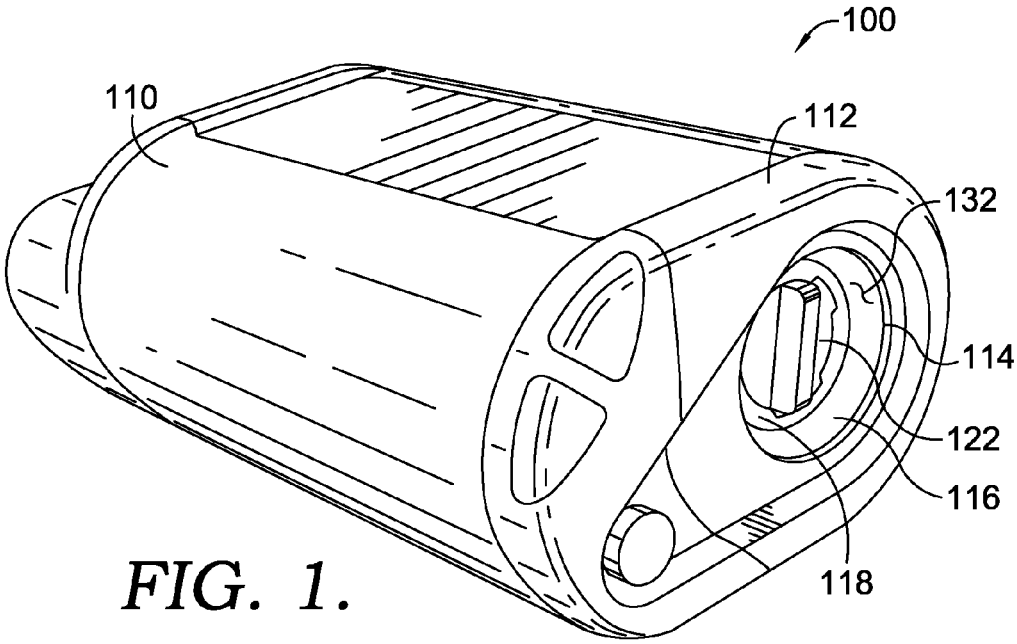
FIG. 1 is a front perspective view of a mobile printer, in accordance with an embodiment of the present invention.

Embodiments of the present invention relate generally to a system, method, and/or apparatus for easily loading a media roll into a mobile printer. The mobile printer generally comprises a printer body and a printer door. When the printer door is in an open position, a media roll having an outer portion (e.g., media) and an inner portion (e.g., hollow tube) is easily loaded into a recessed area of the printer body from a side of the printer body. In embodiments, a battery spindle extends from a side surface of the recessed area through the inner portion of the media roll. Batteries used to power the mobile printer are then loaded into the battery spindle, thus consolidating the space required for the media roll and the batteries. In one instance, there is only one way that the media roll can be loaded into the mobile printer, thus eliminating any ambiguity in how the media roll is loaded. In another instance, the media roll is provided to a user with the batteries already housed within the media roll. In these instances, there may or may not be a battery spindle extending from the recessed area of the mobile printer. In a further embodiment, an external battery accessory can optionally be attached to a back portion of the mobile printer to provide more power to the printer, and in particular, faster printing. In embodiments, the mobile printer is a direct thermal type printer.

According to a first embodiment, a mobile printer is provided comprising a printer body having a recessed area that defines an open space for receiving a media roll, the media roll having a void interior portion that is capable of receiving one or more batteries that power the mobile printer. The mobile printer further includes a printer door that is operatively coupled to the printer body such that the printer door, when opened, allows for the media roll and the one or more batteries to be placed into the open space from a side of the printer body. The printer door, when closed, retains the media roll in place relative to the printer body and captures media from the media roll in place for printing.

According to another embodiment, media roll is provided that supplies power to a printer. The media roll includes an outer portion that comprises media on which the printer prints and an inner portion that defines a void area. The media roll further includes one or more batteries that are housed in the void area of the inner portion. The one or more batteries are used to supply power to the printer such that the media roll, when loaded into the printer, provides both the media and the power to the printer.

According to yet another embodiment, a side-loading mobile printer is provided. The side-loading mobile printer includes a printer body having a long axis and a short axis and a recessed area that is sized to receive a media roll having a length that is substantially parallel to the long axis of the printer body. Further, the mobile printer includes a battery spindle that houses one or more batteries that supply power to the mobile printer, the battery spindle extending from a side surface of the recessed area. Additionally, the mobile printer includes a printer door that is operatively coupled to the printer body such that, when the printer door is open, the media roll is placed into the recessed area from a side of the printer body such that the battery spindle extends through a void interior portion of the media roll. Further, when the printer door is closed, the media roll is held in place relative to the printer body and media from the media roll is captured between a platen roller coupled to the printer door and a print head.

Turning now to FIG. 1, a front perspective view of a mobile printer 100 is shown, in accordance with an embodiment of the present invention. The mobile printer 100 includes a printer body 110 that houses the components of the mobile printer 100. The printer body 110 may be plastic, metal, aluminum, or any other suitable material. The printer body 110 comprises a print head (not shown) that uses heat to print onto media (e.g., paper). Further, the printer body 110 comprises a printer door 112. On the printer door 112 is a printer door opening 132 through which a portion of a media roll 114 extends. The media roll 114 is discussed and illustrated in more detail below, but generally has an outer portion 116 and an inner portion 118. In one embodiment, the outer portion 116 is comprised of media (e.g., paper, labels) that is wound around the inner portion 118. The inner portion 118, in embodiments, is generally cylindrical is shape and may be composed of any material, such as plastic, paper (e.g., thick cardboard), metal, etc. The media roll 114 is placed into a recessed area (not shown) of the printer body 110. This is shown in more detail herein in reference to FIG. 2. A battery spindle (not shown), in one embodiment, extend from a side surface of the recessed area and when the media roll 114 is placed into the recessed area, the battery spindle extends through a portion of the media roll 114. The battery spindle, in one embodiment, is used to house batteries that power the mobile printer 100. On one end of the battery spindle is a cap 122 that removably attaches or couples to the end of the battery spindle so that the batteries stay inside of the battery spindle. Additionally, the batteries, when spent, may be recharged. In one embodiment, the batteries are recharged while they are still in the printer, such as in the battery spindle. In another embodiment, however, the batteries are removed from the printer and are recharged externally from the printer.

Figure 2:
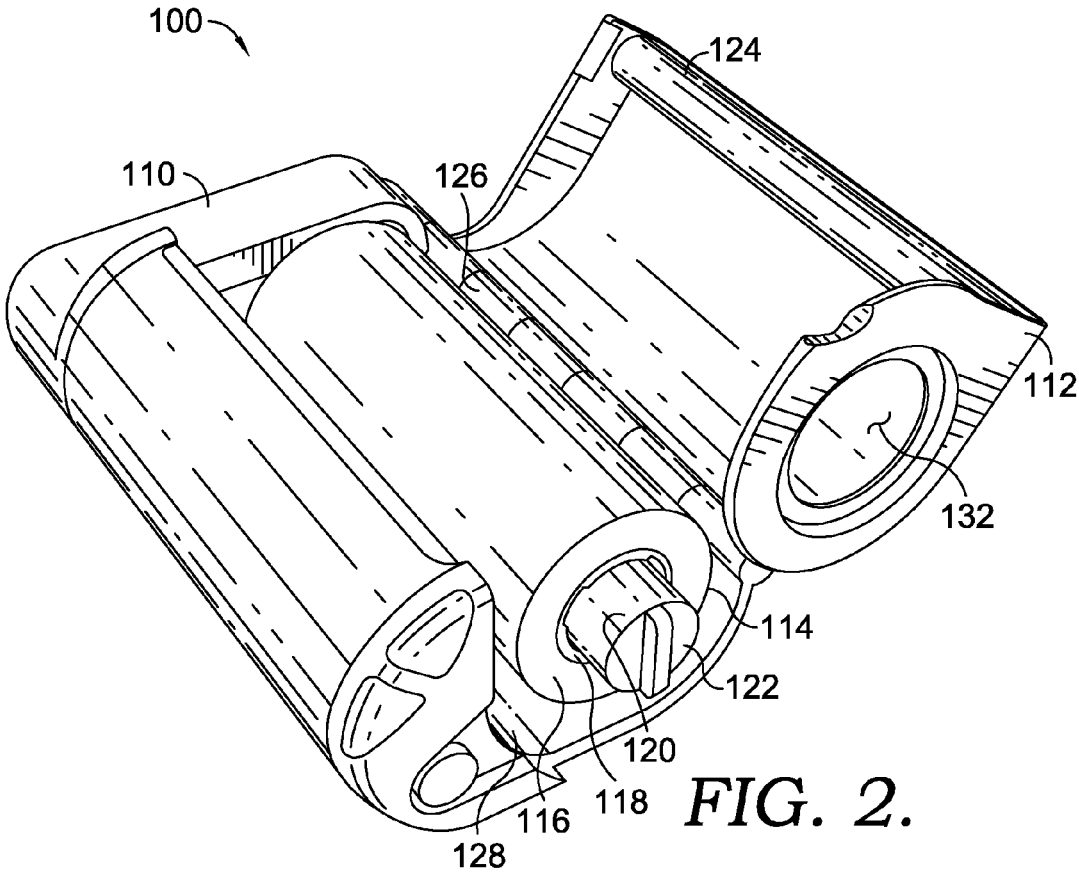
FIG. 2 is a front perspective view of a mobile printer with the printer door in an open position, in accordance with an embodiment of the present invention.

FIG. 2 is a front perspective view of a mobile printer 100 with the printer door in an open position, in accordance with an embodiment of the present invention. Similar to the mobile printer 100 illustrated in FIG. 1, the mobile printer 100 in FIG. 2 comprises a printer body 110 that has a printer door 112. When the printer door 112 is open, as shown here, the media roll 114 can be more easily viewed. The media roll 114 comprises an outer portion 116 and an inner portion 118 through which the battery spindle 120 extends. At the end of the battery spindle 120 is a cap 122 so that the batteries that are placed within the battery spindle 120 are kept in place and cannot fall out of the spindle. As previously mentioned, the batteries that power the mobile printer 100 are placed inside of the battery spindle 120, which allows the overall size of the mobile printer 100 to be smaller. As such, batteries, which typically are stored in some other portion of a printer, are stored within the otherwise wasted space inside of the media roll 114 in the embodiment of FIG. 2. This substantially reduces the overall size of the mobile printer, as media rolls and batteries typically take up the most space in printers. In one embodiment, the batteries are Lithium-ion 18650 battery cells that fit into the hollow area of a media roll. The length of the media roll may be any size, given that its length is the same or less than the length of the mobile printer 100. As such, in one instance, the media roll is four inches in length.

Generally, the mobile printer 100 has a long length and a short length. In embodiments, the length of the media roll is parallel to the long axis of the mobile printer 100. This indicates that the mobile printer 100 described herein more closely approaches the smallest possible size of a mobile printer when compared to other mobile printers. When the length of the media roll is perpendicular to the long axis of the printer, this indicates that the printer size in relation to the media length or size is not fully optimized. When, however, the length of the media roll is parallel to the long axis of the mobile printer, this indicates that the size of the printer in relation to the media length is optimized. Additionally, in one embodiment, the length of the media roll 114 is substantially similar to the length (e.g., long axis) of the printer body 110. In an alternative embodiment, however, the length of the media roll is slightly shorter or slightly less than the length (e.g., long axis) of the printer body 110. For instance, the length of the media roll 114 in one embodiment is between 75% and 100% of the length of the long axis of the printer body 110. Here, the length of the media roll may be subordinate to a long axis length of the printer body by 5% to 25%. Alternatively, the difference between the length of the media roll and the length of the long axis of the printer body may be, for example, anywhere from 0.1 to 2 inches.

The printer door 112 further comprises a printer door opening 132 that allows for the cap 122 on the batter spindle 120, and thus the batteries housed inside the battery spindle 120, to be accessed even when the printer door 112 is in a closed position. Additionally, the printer door 112 comprises a platen roller 124. In one embodiment, the mobile printer 100 is a thermal printer. In this embodiment, the platen roller 124 creates pressure on the media by pressing it firmly against the print head so that the media of the media roll 114 is printed on evenly. This allows heat from the thermal print head to flow into the media.

As shown in FIG. 2, the printer body 110 comprises a recessed area 128. The recessed area 128 provides space in which the media roll 114 is placed. In one embodiment, the media roll 114 comprises just the outer portion 116 and the inner portion 118. In an alternative embodiment, however, the media roll 114 comprises both the outer portion 116 and the inner portion 118, but also comprises batteries that are located inside of the inner portion 118. In some cases, the media roll 114 may be purchased with the batteries already inside of the inner portion 118. When the paper on the outer portion 116 of the media roll 114 is spent, the entire media roll 114, including the batteries, may be sent to a predetermined location so that the batteries can be charged and so the media on the media roll 114 can be replenished. The power provided by the batteries, for instance, may be just enough to allow for the printing of the media on one media roll 114. This embodiment is discussed further herein in relation to FIG. 8. In one embodiment, the media roll 114 is loaded or placed into the recessed area 128 by placing the media roll 114 around the battery spindle such that the media roll 114 enters the printer from the side of the printer body 110 and such that the battery spindle 120 extends through the inner portion 118 of the media roll 114. In this embodiment where the media roll 114 is loaded into the mobile printer 100 from the side of the printer, there may be only one way that the media roll 114 can be loaded into the mobile printer 100. This may be dictated by the size and shape of the inner portion 118 of the media roll 114 and the size and shape of the battery spindle 120. For example, features of the battery spindle (e.g., size, shape) and features of the media roll (e.g., size and shape of the inner portion) are arranged to prevent loading of the media roll in an incorrect orientation. Therefore, when a user of the mobile printer 100 attempts to load a new media roll 114 into the recessed area 128 of the printer, there is only one way that the media roll 114 fits into the recessed area 128. This avoids the media roll 114 being loaded incorrectly into the mobile printer 100. Additionally, when the printer door 112 is in a closed position, several actions may result. For instance, in one embodiment, closing the printer door 112 captures the media of the media roll 114 between the platen roller 124 and the print head. Further, closing the printer door 112 also retains the media roll 114 so that it stays in place in relation to the mobile printer 100.

Figure 3:
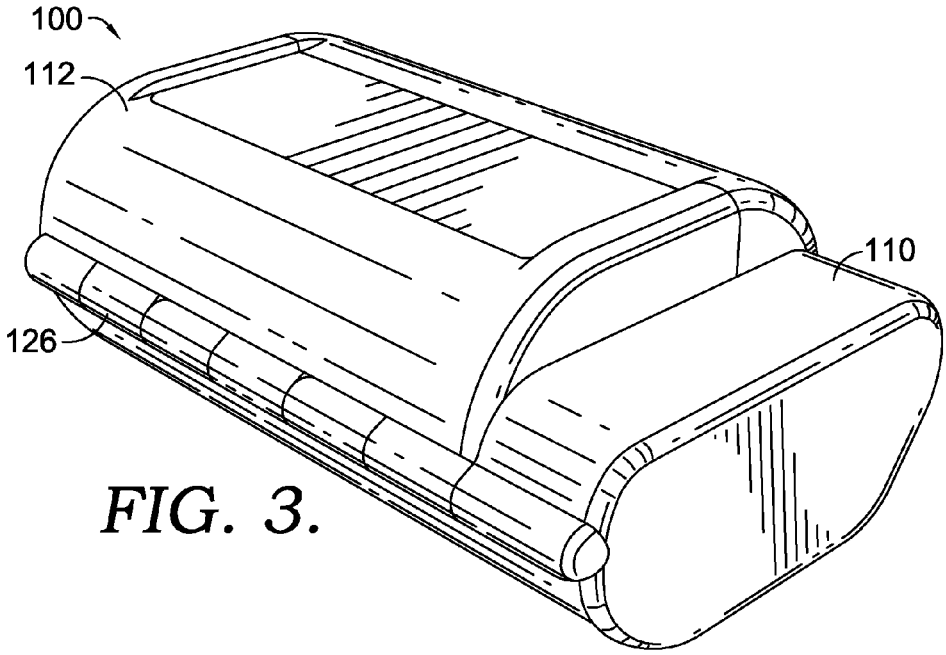
FIG. 3 is a rear perspective view of a mobile printer, in accordance with an embodiment of the present invention.

Turning now to FIG. 3, a rear perspective view is shown of a mobile printer 100, in accordance with an embodiment of the present invention. This view is provided to illustrate the mobile printer 100 from the rear. The printer body 110 comprises the printer door 112. As shown here in FIG. 3, the printer door 112 is closed. A printer door hinge 126 allows for the printer door 112 to open and close.

Figure 4:
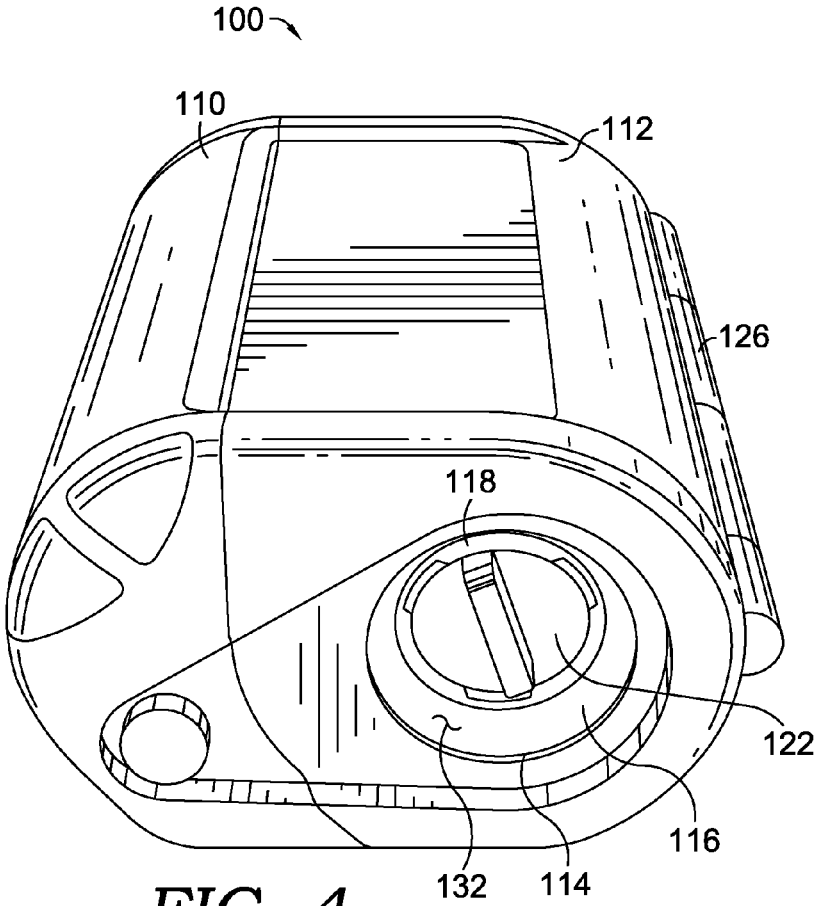
FIG. 4 is a side perspective view of a mobile printer, in accordance with an embodiment of the present invention.

Referring to FIG. 4, a side perspective view of a mobile printer 100 is illustrated, in accordance with an embodiment of the present invention. Again, mobile printer 100 comprises a printer body 110 having a printer door 112. The printer door hinge 126 is also shown in the view of FIG. 4. The printer door has a cutout of an open space, termed the printer door opening 132, which allows for access of the cap 122, and in particular, the batteries. The media roll 114 is shown with an outer portion 116 and an inner portion 118. As previously described, in one embodiment, the outer portion 116 of the media roll 114 comprises media that is wound around the inner portion 118, which may be cylindrical in shape. In one embodiment, the cap 122 removably attaches to the inner portion 118 of the media roll 114, but in another embodiment, the cap 122 removably attaches to a battery spindle that extends through a portion of the media roll 114, such as through a portion of the inner portion 118 of the media roll 114.

Figure 5:
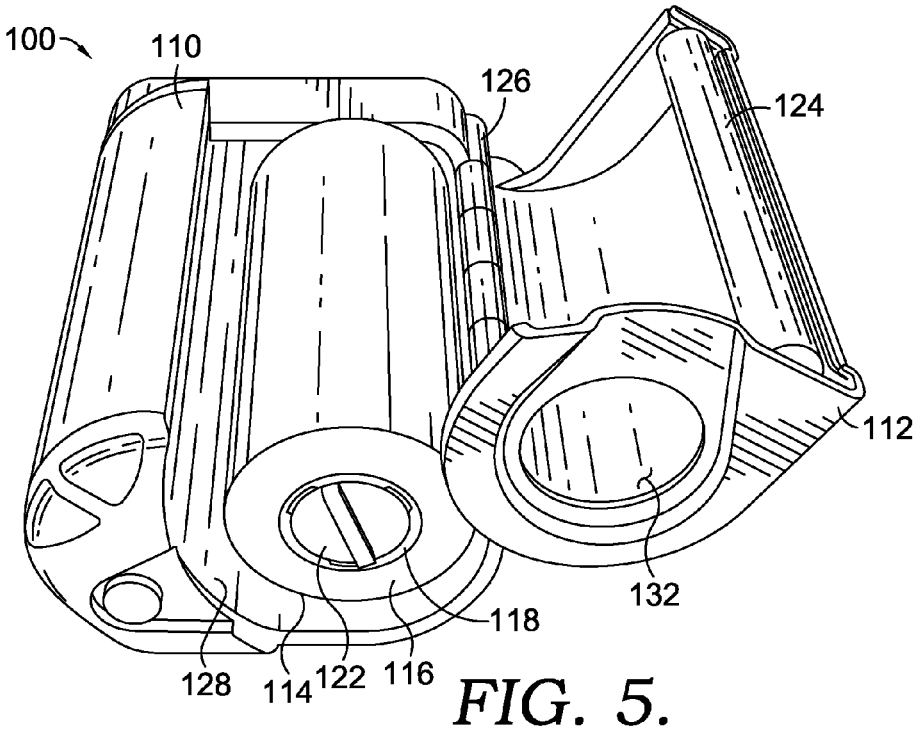
FIG. 5 is a side perspective view of a mobile printer with the printer door in an open position, in accordance with an embodiment of the present invention.

FIG. 5 is another side perspective view of a mobile printer 100 with the printer door open, in accordance with an embodiment of the present invention. The mobile printer 100 comprises a printer body 110 that houses various printer components. The printer body 110 comprises a printer door 112 and a recessed area 128 that receives a media roll 114. The media roll 114 comprises an outer portion 116 and an inner portion 118. In embodiments, the inner portion 118 is cylindrical in shape and defines a void area where the battery spindle is placed when the media roll 114 is loaded into the mobile printer 100. At one end of the battery spindle is a cap 122 that acts as a barrier such that batteries that are placed within the battery spindle stay in place in relation to the printer. The printer door 112 has a printer door opening 132 that allows a portion of the media roll 114 and the cap 122 to be viewable even when the printer door 112 is in a closed position. Additionally, the printer door comprises a platen roller 124 that, when the printer door 112 is in a closed position, creates pressure on the media of the media roll 114 such that the media is firmly pressed against the print head located in the printer body 110. In one embodiment, the mobile printer is a thermal printer, and the media must be pressed firmly against the print head for the heat from the print head to evenly print on the media. The printer door 112 opens and closes via a printer door hinge 126. While a hinge is illustrated in embodiments of the present invention, other mechanisms that allow the printer door 112 to open and close may also be used, and are contemplated to be within the scope of the present invention.

Figure 6:
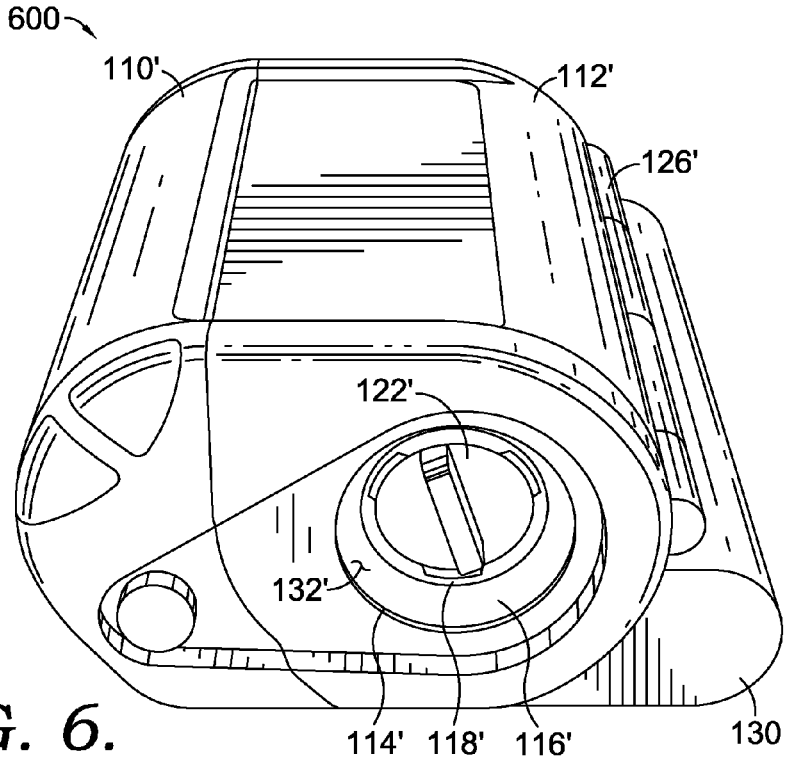
FIG. 6 is a side perspective view of a mobile printer with an external battery accessory, in accordance with an embodiment of the present invention.

Turning now to FIG. 6, a side perspective view is depicted of a mobile printer 600 with an external battery accessory, in accordance with an embodiment of the present invention. Similar to other embodiments described herein, the embodiment of FIG. 6 comprises a printer body 110' and a printer door 112' having a printer door hinge 126' that allows the printer door 112' to be moved from an open position to a closed position, and vice versa. A printer door opening 132' on the printer door 112' allows for a portion of the media roll 114' and the cap 122' to be seen, even when the printer door 112' is closed. The media roll 114' comprises an outer portion 116' and an inner portion 118'.

Unlike the embodiments of the present invention described above, the mobile printer 600 of the embodiment of FIG. 6 includes an external battery accessory 130. The user of the mobile printer described herein is given an option as to whether to optimize the printer for size and weight, or to optimize the printer for print speed. Therefore, users who heavily value the compact size of the printer may elect to use the printer with power only from the batteries located within the media roll 114'. In one instance, there are two (2) lithium-ion battery cells inside the media roll 114'. Other users, however, may choose to use an additional external battery accessory 130 that removably couples to a back portion of the printer. In one embodiment, the external battery accessory 130 snaps on to the printer. This provides more battery power. In some instances, double the battery power is provided, such that is there are two battery cells within the media roll 114', there are two more in the external battery accessory 130. This additional battery power provides for a significantly increased print speed. While two batteries are described herein, the battery spindle and the external battery accessory may house any number of batteries. For instance, different types of batteries are sized differently, and thus a greater quantity of a smaller type of battery may be used in the same space as two lithium-ion 18650 batteries.

Figure 7:
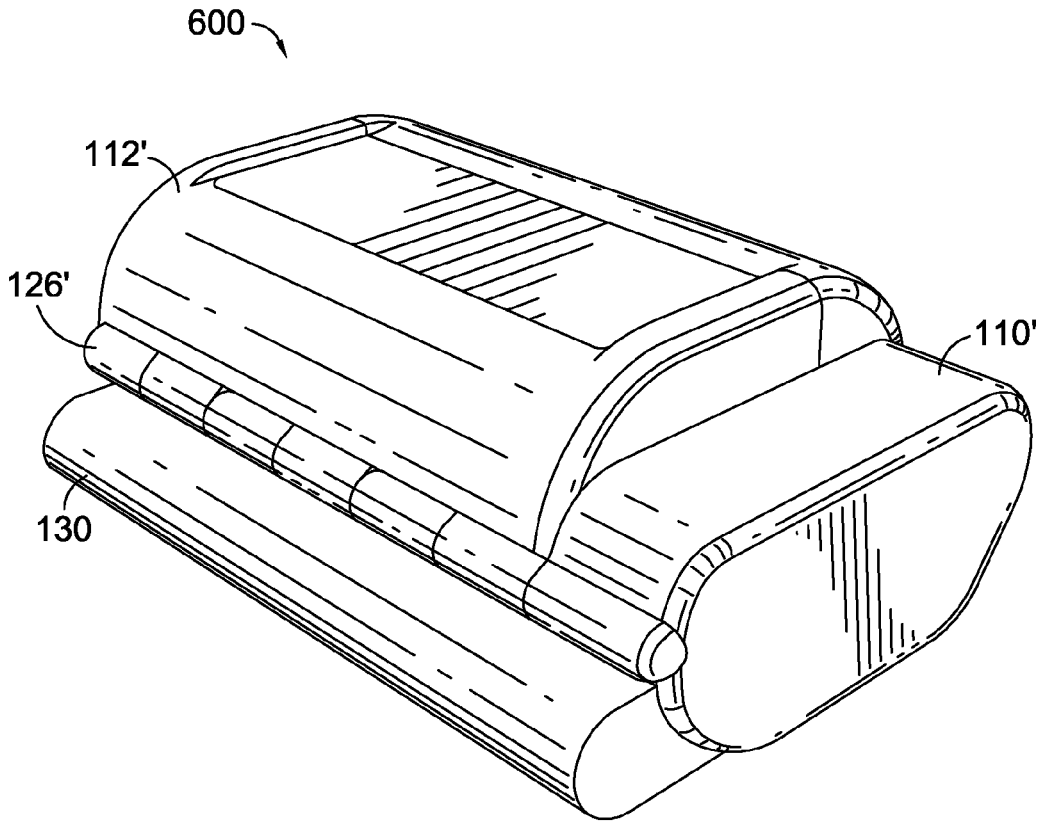
FIG. 7 is a rear perspective view of a mobile printer with an external battery accessory, in accordance with an embodiment of the present invention.

FIG. 7 is a rear perspective view of a mobile printer 600 with an external battery accessory, in accordance with an embodiment of the present invention. Like the mobile printer 600 illustrated in FIG. 6, the mobile printer 600 here illustrates an external battery accessory 130 that is optional and provides for faster printing speeds. As shown here, a printer body 110' comprises a printer door 112' having a printer door hinge 126'.

Figure 8:
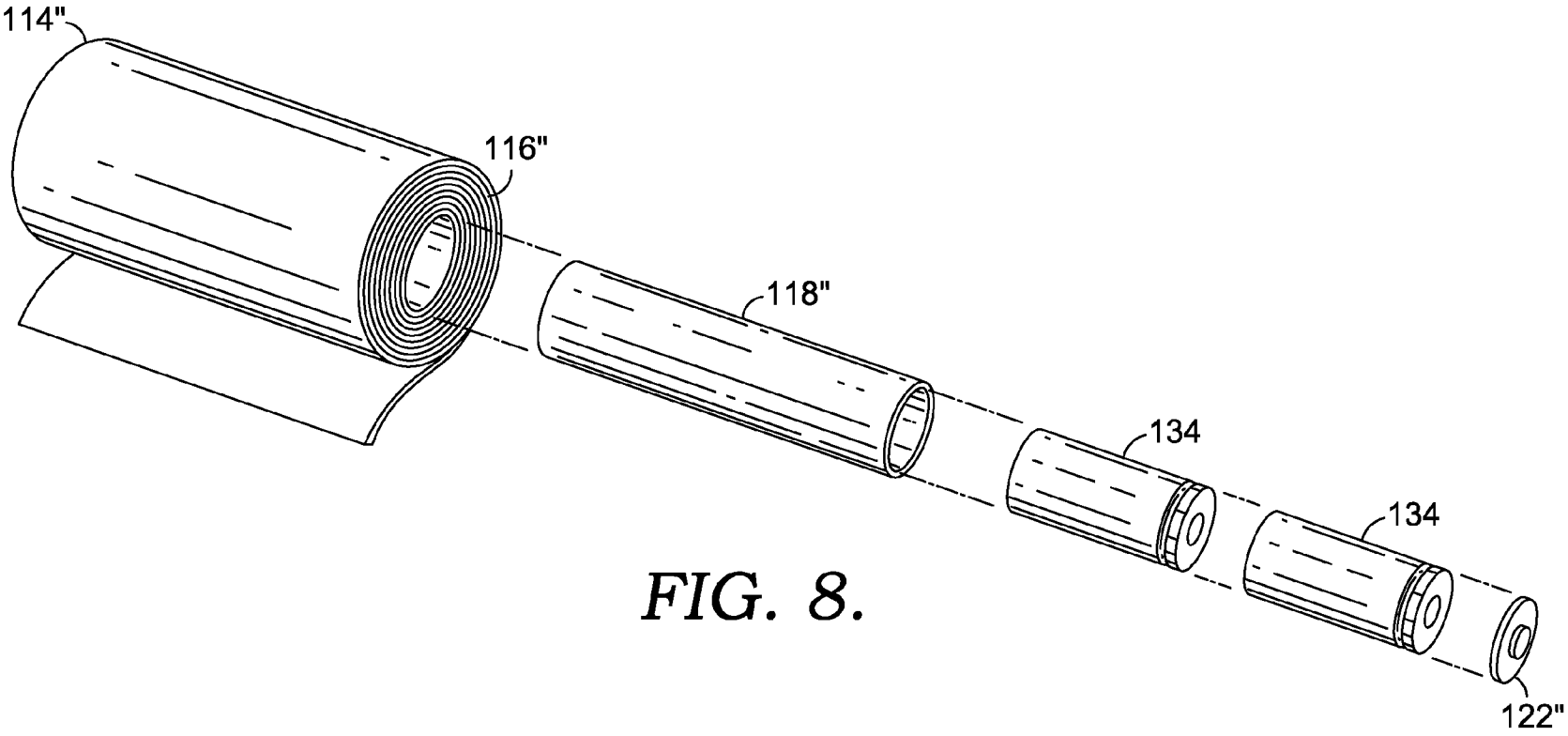
FIG. 8 is an exploded view of a media roll, in accordance with an embodiment of the present invention.

FIG. 8 is an exploded view of a media roll, in accordance with an embodiment of the present invention. The media roll 114" is suitable for use in a printer, such as, for example, a thermal printer. The media roll 114" comprises an outer portion 116", which, in one embodiment, is media (e.g., paper). An inner portion 118" of the media roll 114" is generally cylindrical in shape and may be composed of any material that is not easily bent out of shape, such as plastic, thicker paper (e.g., cardboard), metal, etc. The inner portion 118" defines a void area that allows for the housing of one or more batteries. Here, two batteries 134 are illustrated, but other quantities of batteries including batteries shaped and sized differently than the batteries 134 illustrated in FIG. 8 are contemplated to be within the scope of the present invention. At the end of the media roll 114" is a cap 122" that ensures that the batteries stay within the inner portion 118" of the media roll 114".

While the embodiment of FIG. 8 illustrates that the batteries are physically located inside the inner portion of the media roll, in alternate embodiments, the batteries may be located somewhere other than the inner portion of the media roll. For instance, in embodiment of the present invention, a pre-packaged cartridge containing, at least, both the batteries and the media roll can be used to both power the printer and provide media. These components may be packaged together such that they are one component that is loaded into the printer rather than two separate components. Instead of requiring the user of the printer to load both the batteries and the media roll into the printer, the user here is only required to load the pre-packaged cartridge, as it contains both the batteries and the media roll. As mentioned, the batteries may be located either within the hollow core (e.g., inner portion) of the media roll or somewhere outside of the inner portion. In one embodiment, the pre-packaged cartridge is loaded into the mobile printer from the top of the printer, but according to another embodiment, the pre-packaged cartridge is loaded into the printer from the side of the printer. The use of the pre-packaged cartridge has many advantages, in that it allows the user to load only one component into the printer instead of two. Further, it allows the user to send the entire pre-packaged cartridge to a third party in one piece so that the batteries can be recharged and so that the media roll can be rewound with new media. Once recharged and rewound, the media roll may then be sent back to the user or to another user for use in the mobile printer.

As briefly discussed above, in one embodiment, the media roll 114" may be sent to a user of the mobile printer with the batteries already charged and housed inside the media roll 114". In these embodiments, the batteries may not be charged by the user of the mobile printer, but may be charged by a third party that charges the batteries, restocks the media on the media roll 114", and sends the media roll 114" with recharged batteries back to the user. As such, when a user loads the media roll 114" into the mobile printer, the power for the printer is simultaneously provided. Once the media from the media roll 114" is spent, the entire media roll 114" may be sent to a third party so that the media rolls can be re-wound (e.g., adding paper to the roll) and so that the batteries can be charged. In this embodiment, there is no need for any battery charging electronics on the printer itself, as the user is not even responsible for recharging the batteries used to power the printer. Effectively, the printer is no longer a machine that requires charging. In a further embodiment, the outside of the inner portion 118" of the media roll 114" has a pre-printed shipping label on it so once the media roll 114" is spent, the user simply ships it to a third party for re-winding and recharging.

As a further explanation of the above, batteries that power the mobile printer using the embodiment of the media roll illustrated in FIG. 8 are delivered to the customer in each roll of media, located in the core tube in the center of the media roll. While in one embodiment the batteries are physically located inside the hollow core of the media roll, according to other embodiments, the batteries are not located within the media roll but are packaged together with the media roll such that the pre-packaged cartridge containing the media roll and batteries is loaded into the mobile printer in a single step such that the package both provides media to the printer and provides the power for the printing of the printer. In either embodiment regardless of the location of the batteries, when a user installs a new media roll with charged batteries, the printer powers up. When the media is used up, the core tube with discharged batteries is returned to a third party for battery charging and paper winding. From the user's point of view, the printer has no batteries, does not ever need charging, and there is no need to purchase batteries, charge docks, or power supplies. The media roll may simply be dropped in the mail when it is consumed, and returned to the user with charged batteries and additional media. In one embodiment, the outside of the core (e.g., inner portion) includes a shipping label that allows the user to simply drop the core and contained batteries in the mail for recharging and media.

Figure 9:
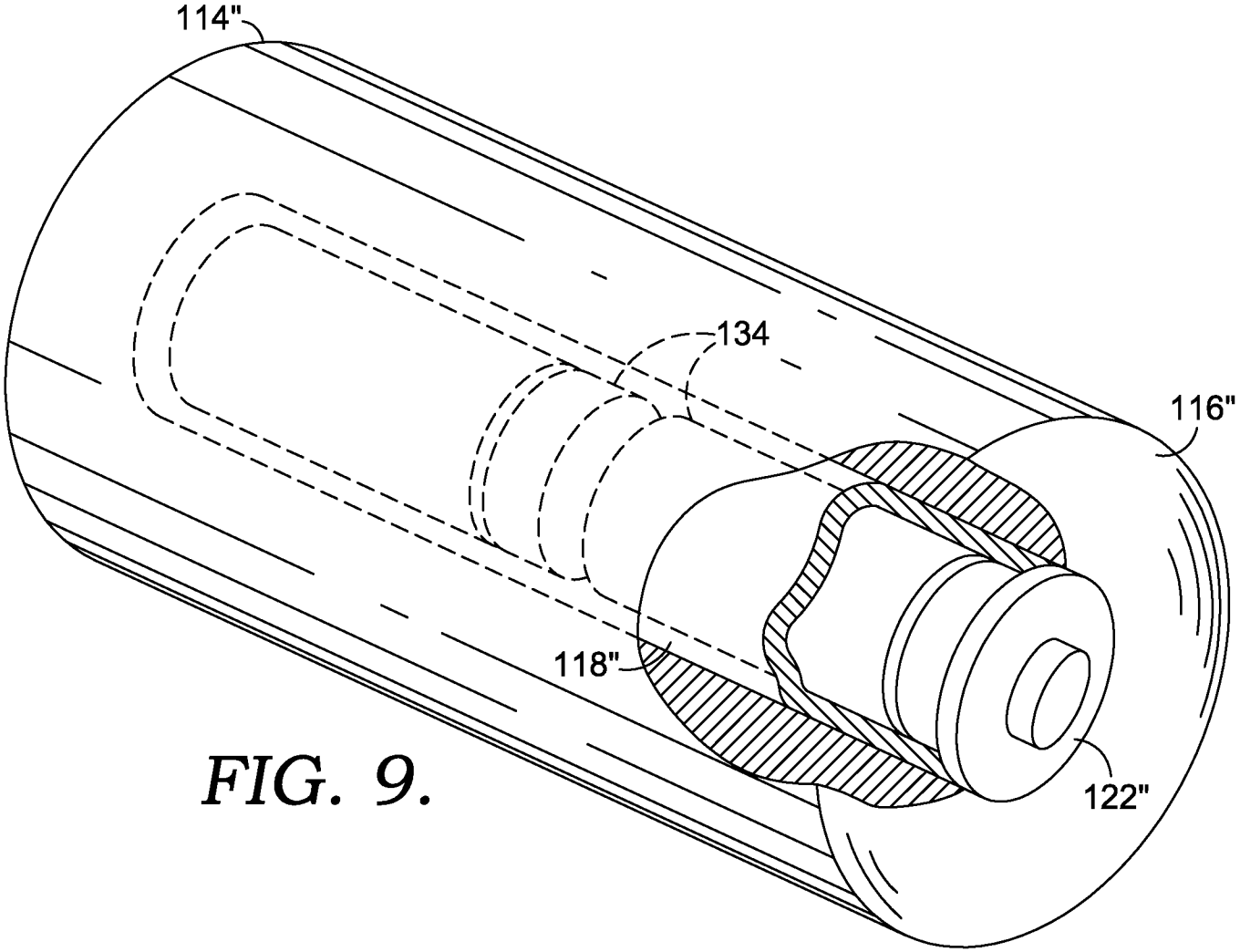
FIG. 9 is a cross-sectional view of a media roll, in accordance with an embodiment of the present invention.

Turning now to FIG. 9, a cross-sectional view of a media roll is illustrated, in accordance with an embodiment of the present invention. The media roll 114" of FIG. 9 comprises an outer portion 116" and an inner portion 118". The cross-sectional view illustrates the various layers of the media roll 114". For instance, starting from the outside, an outer portion 116" typically comprises rolls of paper, labels, etc. on which the mobile printer prints. An inner portion 118" made out of plastic, paper, metal, etc., defines an open space having one or more batteries 134. Two batteries 134 are illustrated here. On the end of the inner portion 118" is a cap 122". The dashed lines illustrate hidden lines. For instance, the inner portion 118" cannot be seen unless the media roll 114" is spent and the media has been completely used. The batteries cannot be seen while housed in the center of the media roll 114".

Many different arrangements of the various components depicted, as well as components not shown, are possible without departing from the spirit and scope of embodiments of the present invention. Embodiments of the present invention have been described with the intent to be illustrative rather than restrictive. Certain features and subcombinations are of utility and may be employed without reference to other features and subcombinations and are contemplated to be within the scope of the claims.

The invention claimed is:

1. A mobile printer comprising:

a printer body having a recessed area that defines an open space for receiving a media roll, the media roll having a void interior portion that is capable of receiving one or more batteries that power the mobile printer; and a printer door having a printer door opening and being operatively coupled to the printer body such that the printer door:

when opened, allows for the media roll containing the one or more batteries to be placed into the open space from a side of the printer body, and when closed, retains the media roll in place relative to the printer body, captures media from the media roll in place for printing, and permits access to the void interior portion of the media roll though the printer door opening.

2. The mobile printer of claim 1, wherein the mobile printer is a direct thermal type printer.

3. The mobile printer of claim 1, wherein the printer door is coupled to a platen roller that is spring loaded to firmly press the media against a print head.

4. The mobile printer of claim 3, wherein when the printer door is closed, the media from the media roll is captured between the platen roller and the print head that is located in the printer body.

5. The mobile printer of claim 1, further comprising an external battery accessory that is optionally coupled to the printer body to provide additional power to the mobile printer.

6. The mobile printer of claim 5, wherein the additional power provided by the external battery accessory allows for faster printing.

7. The mobile printer of claim 1, wherein a length of the media roll, when received into the open space, is parallel to a long axis of the printer body.

8. A pre-packaged cartridge for use in a mobile printer, the pre-packaged cartridge comprising:

a media roll comprising, (1) an outer portion that comprises media on which the mobile printer prints, and (2) an inner portion; and one or more batteries that are used to supply power to the mobile printer, wherein the power supplied by the one or more batteries is sufficient for printing on the media of about one media roll, such that the pre-packaged cartridge, when loaded into the mobile printer, provides both the media and the power to the printer.

9. The pre-packaged cartridge of claim 8, wherein the one or more batteries are housed in a void area defined by the inner portion of the media roll.

10. The pre-packaged cartridge of claim 8, wherein the media roll is loaded into a recessed portion of a printer body from a top of the printer.

11. The pre-packaged cartridge of claim 8, wherein the pre-packaged cartridge is sent to a third party once one or more of the one or more batteries or the media are exhausted such that the one or more batteries are recharged and the media roll is rewound, and wherein once the one or more batteries are recharged and the media roll is rewound, the pre-packaged cartridge is sent to a user of the mobile printer.

12. The pre-packaged cartridge of claim 8, wherein an outer surface of the inner portion of the media roll has a shipping label that allows a user of the media roll to ship the media roll to a third party for battery recharging and media rewinding once one or more of the one or more batteries or the media are exhausted.

13. The pre-packaged cartridge of claim 8, wherein a length of the media roll is parallel to a long axis of a printer body into which the media roll is placed.

14. A side-loading mobile printer comprising:

a printer body having a long axis and a short axis;

a recessed area that is sized to receive a media roll having a length that is substantially parallel to the long axis of the printer body;

a battery spindle that houses one or more batteries that supply power to the mobile printer, the battery spindle extending from a side surface of the recessed area; and a printer door that is operatively coupled to the printer body such that, (1) when the printer door is open, the media roll is placed into the recessed area from a side of the printer body such that the battery spindle extends through a void interior portion of the media roll, wherein an interior surface of the media roll is sized and shaped such that there is only one way the media roll can be loaded into the recessed area of the printer body, and (2) when the printer door is closed, the media roll is held in place relative to the printer body and media from the media roll is captured between a platen roller coupled to the printer door and a print head.

15. The mobile printer of claim 14, further comprising an external battery accessory that is removably coupled to the printer body to provide additional power to the printer, thus providing for faster printing.

16. The mobile printer of claim 14, wherein the mobile printer is a direct thermal type printer.

17. The mobile printer of claim 14, wherein features of the battery spindle and features of the media roll are arranged to prevent loading of the media roll in an incorrect orientation.

18. The mobile printer of claim 14, wherein the length of the media roll is subordinate to a long axis length of the printer body by 5% to 25%.

19. The mobile printer of claim 14, wherein the platen roller is spring loaded such that the media, when the printer door is closed, is firmly pressed against the print head, wherein the print head is housed within the printer body.

* * * * *